US009620874B2

(12) United States Patent
Takemoto

(10) Patent No.: US 9,620,874 B2
(45) Date of Patent: Apr. 11, 2017

(54) CIRCUIT BOARD CONNECTING DEVICE AND RELEASING TOOL

(71) Applicant: DAI-ICHI SEIKO CO., LTD., Kyoto (JP)

(72) Inventor: Masatoshi Takemoto, Tokyo (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 45 days.

(21) Appl. No.: 14/142,537

(22) Filed: Dec. 27, 2013

(65) Prior Publication Data

US 2014/0187059 A1 Jul. 3, 2014

(30) Foreign Application Priority Data

Dec. 28, 2012 (JP) ..... 2012-286461

(51) Int. Cl.

| | |
|---|---|
| ***H01R 13/633*** | (2006.01) |
| ***H01R 13/629*** | (2006.01) |
| ***H01R 13/639*** | (2006.01) |
| ***H01R 12/71*** | (2011.01) |
| ***H01R 12/88*** | (2011.01) |
| *H01R 13/627* | (2006.01) |

(52) U.S. Cl.

CPC ..... *H01R 12/716* (2013.01); *H01R 12/88* (2013.01); *H01R 13/633* (2013.01); *H01R 13/629* (2013.01); *H01R 13/6278* (2013.01)

(58) Field of Classification Search

CPC .. H01R 13/639; H01R 12/52; H01R 13/6271; H01R 13/6278; H01R 12/88; H01R 13/633

USPC ..... 439/74, 372, 607.35, 607.36

See application file for complete search history.

(56) References Cited

U.S. PATENT DOCUMENTS

| | | | | |
|---|---|---|---|---|
| 6,645,005 | B2 * | 11/2003 | Wu | 439/563 |
| 8,647,141 | B2 * | 2/2014 | Lee et al. | 439/372 |
| 2011/0263140 | A1 * | 10/2011 | Sato et al. | 439/74 |

FOREIGN PATENT DOCUMENTS

| | | | |
|---|---|---|---|
| JP | 2000-260509 | A | 9/2000 |
| JP | 2004-055306 | A | 2/2004 |

* cited by examiner

*Primary Examiner* — Felix O Figueroa
*Assistant Examiner* — Paul Baillargeon
(74) *Attorney, Agent, or Firm* — Studebaker & Brackett PC

(57) ABSTRACT

A circuit board connecting device comprises a first connector having a first fixing metallic member attached to a first insulating housing, a second connector having a second fixing metallic member attached to a second insulating housing, a resilient movable holding member provided on the first connector to have a pair of end portions supported respectively by the first fixing metallic member, and a pair of engaging portions formed on the second fixing metallic member so that the end portions of the resilient movable holding member are caused to engage respectively with the engaging portions when the second insulating housing is coupled with the first insulating housing, wherein each of the engaging portions is constituted with a hole through which the end portion of the resilient movable holding member passes from the outside to the inside of the second fixing metallic member.

3 Claims, 15 Drawing Sheets

CIRCUIT BOARD CONNECTING DEVICE AND RELEASING TOOL

BACKGROUND OF THE INVENTION

Field of the Invention

The present invention relates generally to a circuit board connecting device, and more particularly to an improvement in a circuit board connecting device which is used for putting first and second groups of circuit terminals provided respectively on a couple of separate circuit boards in mutual electrical connection so that the separate circuit boards are electrically connected with each other under a condition wherein one of the separate circuit boards is closely laid on top of the other of the separate circuit boards.

Description of the Prior Art Including Information Disclosed Under 37 CFR 1.97 and 37 CFR 1.98

Various kinds of electric or electronic parts are built even in a relatively small-sized electronic apparatus such as a mobile phone or the like. A major part of those parts are dispersedly mounted on, for example, a couple of separate circuit boards to fulfill their respective functions. In the relatively small-sized electronic apparatus, having an eye to the couple of separate circuit boards on which the electric or electronic parts are mounted, it is likely that one of the separate circuit boards is required to be closely laid on top of the other of the separate circuit boards for reducing a space occupied thereby when the separate circuit boards are electrically connected with each other. Such electrical connection between the separate circuit boards wherein one is closely laid on top of the other is hereinafter referred to as electrical piled-up connection.

In general, when a plurality of circuit boards, such as solid circuit boards, are electrically connected with one another, a plurality of electrical connectors are mounted on the circuit boards, respectively, and one of the electrical connectors is coupled with another electrical connector so as to connect one of the circuit boards electrically with another circuit board. In case of the electrical piled-up connection mentioned above, first and second electrical connectors are mounted respectively on the separate circuit boards to be coupled with each other. The first electrical connector is formed into a plug type connector and the second electrical connector is formed into a receptacle type connector to be a mate electrical connector for the first electrical connector, so that the plug type connector is engaged with the receptacle type connector when the separate circuit boards are put in a condition of the electrical piled-up connection.

Under such a situation, there have been previously proposed several circuit board connecting devices, each of which is used for putting a couple of circuit boards in the electrical piled-up connection, as disclosed in, for example, the Japanese patent application published before examination under publication number 2000-260509 (hereinafter, referred to as published prior art document 1) and the Japanese patent application published before examination under publication number 2004-55306 (hereinafter, referred to as published prior art document 2).

A circuit board connecting device disclosed in the published prior art document 1 comprises a first connector (a connector piece (100)) mounted on a surface of a first circuit board (a board 110)) so as to be fixed to the first circuit board and a second connector (a connector piece (200)) mounted on a surface of a second circuit board (a board 210)) so as to be fixed to the second circuit board, wherein the first and second circuit boards are to be subjected to the electrical pile-up connection. The first connector is provided with a plurality of first contacts (contacts (120)) arranged on a housing (130) and the second connector is provided with a plurality of second contacts (contacts 220)) arranged on a housing (230). Each of the first contacts has a top end portion thereof folded back in the shape of U to be resiliently transformed.

When the surface of the first circuit board on which the first connector is mounted is caused to be opposite to the surface of the second circuit board on which the second connector in mounted so that the first circuit board is closely laid on top of the second circuit board, the first and second connectors coupled with each other and the top end portion of each of the first contacts of the first connector comes into contact with a corresponding one of the second contacts of the second connector. Thereby, the first contacts of the first connector are connected respectively with the second contacts of the second connector and the first and second circuit boards are put in a condition of the electrical piled-up connection.

With the first and second circuit boards thus put in the condition of the electrical piled-up connection, since the top end portion of each of the first contacts of the first connector, which is folded back in the shape of U to be resiliently transformed, is put in press-contact with the corresponding one of the second contacts of the second connector with resilient transformations thereof, it is expected that the first and second contacts are surely connected with each other.

Then, a circuit board connecting device disclosed in the published prior art document 2 comprises a first connector (a plug connector (24)) mounted on a surface of a first circuit board (a printed circuit board (26)) so as to be fixed to the first circuit board and a second connector (a receptacle connector (20)) mounted on a surface of a second circuit board (a printed circuit board (22)) so as to be fixed to the second circuit board, wherein the first and second circuit boards are to be subjected to the electrical pile-up connection. The first connector is provided with a plurality of first contacts (contact terminals (28Ai), (28Bi)) arranged on a first housing (a base portion (24M)) and the second connector is provided with a plurality of second contacts (contact terminals (34Ai), (34Bi)) arranged on a second housing (a base portion (20M)). An engaging hook (30N) is formed on a coupling portion (30*m*) of a supporting member (30) pushed in the first housing of the first connector and a projection (32*mn*) is formed on a resilient tongue portion (32*mr*) of a supporting member (32) pushed in the second housing of the second connector.

When the surface of the first circuit board on which the first connector is mounted is caused to be opposite to the surface of the second circuit board on which the second connector in mounted so that the first circuit board is closely laid on top of the second circuit board, the first and second connectors coupled with each other and the top end portion of each of the first contacts of the first connector comes into contact with a corresponding one of the second contacts of the second connector. Thereby, the first contacts of the first connector are connected respectively with the second contacts of the second connector and the first and second circuit boards are put in a condition of the electrical piled-up connection.

With the first and second circuit boards thus put in the condition of the electrical piled-up connection, the engaging hook (30N) formed on the coupling portion (30*m*) of the supporting member (30) pushed in the first housing of the first connector is put in engagement with the projection (32*mn*) formed on the resilient tongue portion (32*mr*) of the supporting member (32) pushed in the second housing of the second connector so as to prevent the first housing of the first connector from being separated from the second housing of the second connector. Thereby, the first contacts of the first connector and the second contacts of the second connector are stably connected with each other and consequently it is expected that the electrical piled-up connection between the first and second circuit boards is stably maintained.

In each of the previously proposed circuit board connecting devices used for putting a couple of circuit boards in the electrical piled-up connection as described above, there are the following defects or disadvantages.

In the case of the circuit board connecting device disclosed in the published prior art document 1, any locking means or holding means for preventing the first housing of the first connector from being separated from the second housing of the second connector under a condition wherein the first and second connector are coupled with each other is not provided. Accordingly, when undesirable external force acts on one or both of the first and second connectors coupled with each other, for example, the first contacts of the first connector and the second contacts of the second connector are put in unstable mutual connection and consequently it is feared that the electrical piled-up connection between the first and second circuit boards is not stably maintained.

Further, in the case of the circuit board connecting device disclosed in the published prior art document 2, the engaging hook (30N) which is formed on the coupling portion (30*m*) of the supporting member (30) pushed in the first housing of the first connector and the projection (32*mn*) which is formed on the resilient tongue portion (32*mr*) of the supporting member (32) pushed in the second housing of the second connector and with which the engaging hook (30N) engages, are so provided as to be locking means or holding means for preventing the first housing of the first connector from being separated from the second housing of the second connector under a condition wherein the first and second connector are coupled with each other. However, the engaging hook (30N) cannot be operative to engage firmly with the projection (32*mn*) because of structural limitations in each of the coupling portion (30*m*) of the supporting member (30) on which the engaging hook (30N) is formed and the resilient tongue portion (32*mr*) of the supporting member (32) on which the projection (32*mn*) is formed. Accordingly, when undesirable external force acts on one or both of the first and second connectors coupled with each other, for example, the engaging hook (30N) disengages easily from the projection (32*mn*), so that the first contacts of the first connector and the second contacts of the second connector are put in unstable mutual connection and consequently it is feared that the electrical piled-up connection between the first and second circuit boards is not stably maintained.

BRIEF SUMMARY OF THE INVENTION

Accordingly, it is an object of the present invention to provide a circuit board connecting device for putting a couple of circuit boards in electrical piled-up connection, which includes a first connector having a first insulating housing fixed to a first circuit board, a second connector having a second insulating housing fixed to a second circuit board, and holding means operative to prevent the second insulating housing of the second connector from being separated from the first insulating housing of the first connector under a condition wherein the first and second insulating housings are coupled with each other, and which avoids the aforementioned problems and disadvantages encountered with the prior art.

Another object of the present invention is to provide a circuit board connecting device for putting a couple of circuit boards in electrical piled-up connection, which includes a first connector having a first insulating housing fixed to a first circuit board, a second connector having a second insulating housing fixed to a second circuit board, and holding means operative to prevent the second insulating housing of the second connector from being separated from the first insulating housing of the first connector under a condition wherein the first and second insulating housings are coupled with each other, and with which the mutual coupling between the first and second insulating housings is maintained stably and firmly by the holding means.

A further object of the present invention is to provide a circuit board connecting device for putting a couple of circuit boards in electrical piled-up connection, which includes a first connector having a first insulating housing fixed to a first circuit board, a second connector having a second insulating housing fixed to a second circuit board, and holding means operative to prevent the second insulating housing of the second connector from being separated from the first insulating housing of the first connector under a condition wherein the first and second insulating housings are coupled with each other, and with which the second insulating housing can be smoothly separated from the first insulating housing by quite simple and easy operations under the condition wherein the first and second insulating housings are coupled with each other.

A still further object of the present invention is to provide a circuit board connecting device for putting a couple of circuit boards in electrical piled-up connection, which includes a first connector having a first insulating housing fixed to a first circuit board, a second connector having a second insulating housing fixed to a second circuit board, and holding means operative to prevent the second insulating housing of the second connector from being separated from the first insulating housing of the first connector under a condition wherein the first and second insulating housings are coupled with each other, and with which a thickness of the device in a direction perpendicular to each of surfaces of the first and second circuit boards facing each other can be effectively reduced under a condition wherein the first and second circuit board are put in the electrical piled-up connection.

According to the present invention, there is provided a circuit board connecting device for putting a couple of circuit boards in electrical piled-up connection, which comprises a first connector which has a first insulating housing, a plurality of first contacts arranged on the first insulating housing, each of which is provided with a board connecting portion operative to be connected with a circuit terminal provided on a first circuit board, and a first fixing metallic member attached to the first insulating housing for fixing the first insulating housing to the first circuit board; a second connector which has a second insulating housing operative to be coupled with the first insulating housing, a plurality of second contacts arranged on the second insulating housing, each of which is provided with a board connecting portion operative to be connected with a circuit terminal provided on a second circuit board and is operative to come into contact with a corresponding one of the first contacts, and a second fixing metallic member attached to the second insulating housing for fixing the second insulating housing to the second circuit board; and holding means operative to prevent the second insulating housing from being separated from the first insulating housing under a condition wherein the first and second insulating housings are coupled with each other, wherein a resilient movable holding member is provided on the first connector, which elongates along a longitudinal direction of the first insulating housing to have a pair of end portions supported respectively by a couple of portions of the first fixing metallic member positioned respectively at a pair of end portions of the first insulating housing in its longitudinal direction; a pair of engaging portions are formed respectively on a couple of portions of the second fixing metallic member positioned respectively at a pair of end portions of the second insulating housing in its longitudinal direction; and the end portions of the resilient movable holding member supported by the portions of the first fixing metallic member are caused to engage respectively with the engaging portions formed on the portions of the second fixing metallic member for holding the second insulating housing when the second insulating housing is coupled with the first insulating housing, so that the end portions of the resilient movable holding member supported by the portions of the first fixing metallic member and the engaging portions formed on the portions of the second fixing metallic member constitute the holding means.

In the circuit board connecting device thus constituted in accordance with the present invention, when the second circuit board is closely laid on top of the first circuit board under a condition wherein a surface of the second circuit board on which the second insulating housing of the second connector is mounted to be fixed to the second circuit board is opposite to a surface of the first circuit board on which the first insulating housing of the first connector is mounted to be fixed to the first circuit board, the second insulating housing is coupled with the first insulating housing so that the second contacts arranged on the second insulating housing come into contact respectively with the first contacts arranged on the first insulating housing. Thereby, the first and second connectors are put in mutual connection and the circuit terminals provided on the second circuit board are electrically connected through the first and second contacts respectively with the first circuit terminals provided on the first circuit board, so that the first and second circuit board are put in electrical piled-up connection to be electrically connected with each other.

Under such a condition, the end portions of the resilient movable holding member provided on the first connector to elongate along the longitudinal direction of the first insulating housing, which are supported respectively by the portions of the first fixing metallic member positioned respectively at the end portions of the first insulating housing in its longitudinal direction, are caused to engage respectively with the engaging portions formed on the portions of the second fixing metallic member positioned respectively at the end portions of the second insulating housing in its longitudinal direction so as to hold the second insulating housing. Such a condition of engagement wherein each of the end portions of the resilient movable holding member engages with the engaging portion formed on the portion of the second fixing metallic member is maintained without being broken with resiliency of the resilient movable holding member and thereby each of the end portions of the resilient movable holding member is put in stable engagement with the engaging portion. Accordingly, the end portions of the resilient movable holding member and the engaging portions formed on the portions of the second fixing metallic member constitute the holding means which is operative to prevent the second insulating housing from being separated from the first insulating housing under the condition wherein the first and second insulating housings are coupled with each other.

Then, when each of the end portions of the resilient movable holding member is moved to be released from the engaging portion formed on the portion of the second fixing metallic member, for example, by means of a releasing tool engaged with the end portion of the resilient movable holding member, the condition of engagement wherein each of the end portions of the resilient movable holding member engages with the engaging portion formed on the portion of the second fixing metallic member is broken. As a result, the second insulating housing of the second connector is able to be separated from the first insulating housing of the first connector.

In the resilient movable holding member provided on the first connector for constituting, together with the engaging portions formed on the portions of the second fixing metallic member, the holding means operative to prevent the second insulating housing from being separated from the first insulating housing, each of the end portions supported respectively by the portions of the first fixing metallic member is resiliently movable in regard to the portion of the first fixing metallic member in the longitudinal direction of the first insulating housing of the first connector.

On each of the portions of the first fixing metallic member positioned respectively at the end portions of the first insulating housing of the first connector in its longitudinal direction, for example, a hole through which the end portion of the resilient movable holding member passes to be supported thereby is formed. Further, on each of the portions of the second fixing metallic member positioned respectively at the end portions of the second insulating housing of the second connector in its longitudinal direction, a hole with which the end portion of the resilient movable holding member supported by the portion of the first fixing metallic member engages is formed.

With the circuit board connecting device according to the present invention, when the second insulating housing of the second connector is coupled with the first insulating housing of the first connector and the second contacts arranged on the second insulating housing are put in contact respectively with the first contacts arranged on the first insulating housing, the end portions of the resilient movable holding member provided on the first connector are caused to hold the second insulating housing and thereby the second insulating housing is prevented from being unwillingly separated from the first insulating housing. The resilient movable holding member provided on the first connector elongates along the longitudinal direction of the first insulating housing and the end portions of the resilient movable holding member are supported respectively by the portions of the first fixing metallic member positioned respectively at the end portions of the first insulating housing in its longitudinal direction. The end portions of the resilient movable holding member supported respectively by the portions of the first fixing metallic members are caused to engage respectively with the engaging portions formed on the portions of the second fixing metallic member positioned respectively at the end portions of the second insulating housing in its longitudinal direction for holding the second insulating housing.

The condition of engagement wherein each of the end portions of the resilient movable holding member engages with the engaging portion formed on the portion of the second fixing metallic member is maintained with resiliency of the resilient movable holding member and thereby the second insulating housing is put in a stable holding by the end portions of the resilient movable holding member. Then, when each of the end portions of the resilient movable holding member is resiliently moved to disengage from the engaging portion formed on the portion of the second fixing metallic member, for example, by means of a releasing tool engaged with the end portion of the resilient movable holding member, the condition of engagement wherein each of the end portions of the resilient movable holding member engages with the engaging portion formed on the portion of the second fixing metallic member is broken, so that the second insulating housing of the second connector is able to be separated from the first insulating housing of the first connector.

Accordingly, with the end portions of the resilient movable holding member provided on the first connector and the engaging portions formed on the portions of the second fixing metallic member attached to the second insulating housing of the second connector, which constitute the holding means, the mutual coupling between the first insulating housing of the first connector and the second insulating housing of the second connector is stably and firmly maintained, and then the second insulating housing can be smoothly separated from the first insulating housing by quite simple and easy operations under the condition wherein the first and second insulating housings are coupled with each other.

Further, with the resilient movable holding member provided on the first connector to elongate along the longitudinal direction of the first insulating housing and to have the end portions thereof supported respectively by the portions of the first fixing metallic member positioned respectively at the end portions of the first insulating housing in its longitudinal direction, a thickness of the device between the first and second circuit boards in a direction perpendicular to each of the surfaces of the first and second circuit boards facing each other, on one of which the first insulating housing is mounted and the other of which the second insulating housing is mounted, can be effectively reduced under the condition wherein the first and second circuit board are put in the electrical piled-up connection.

The above, and other objects, features and advantages of the present invention will become apparent from the following detailed description taken in conjunction with the accompanying drawings.

DETAILED DESCRIPTION OF THE INVENTION

Figure 1:
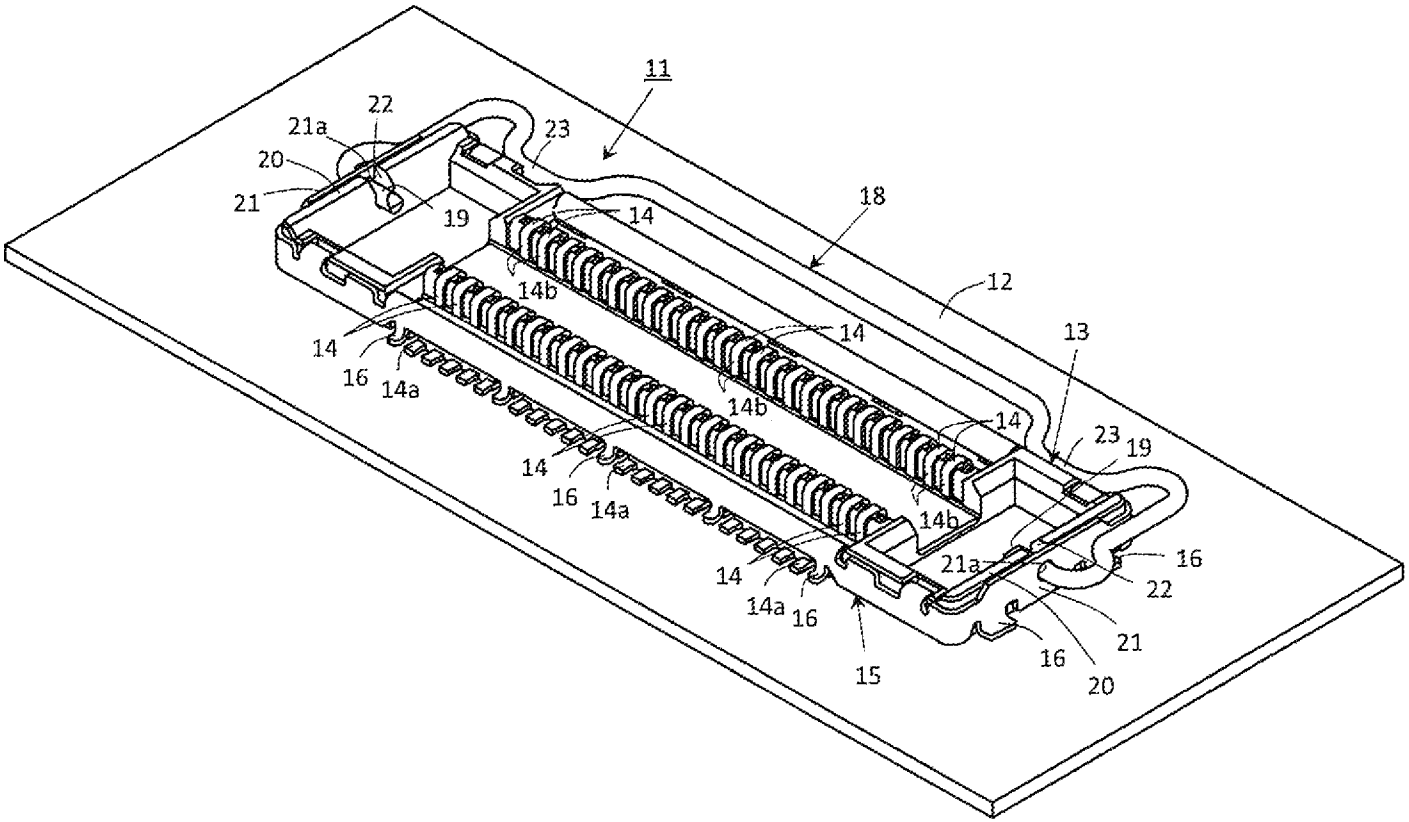
FIG. 1 is a schematic perspective view showing a plug connector included in an embodiment of circuit board connecting device according to the present invention, together with a first circuit board on which an insulating housing of the plug connector is fixed.
Figure 2:
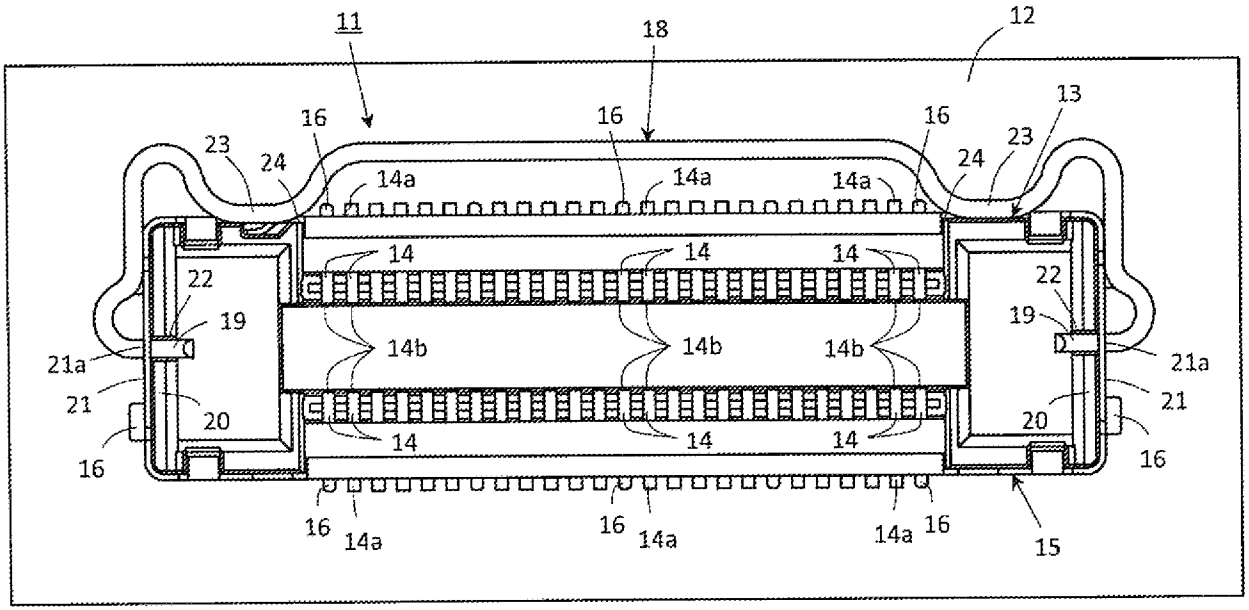
FIG. 2 is a schematic plan view showing the plug connector and the first circuit board.

Each of FIGS. 1 and 2 shows a plug connector 11 which constitutes a first connector included in an embodiment of circuit board connecting device according to the present invention and a first circuit board 12 on which the plug connector 11 is provided. The plug connector 11 has an insulating housing 13 made of insulator such as plastics or the like to constitute a first insulating housing. The insulating housing 13 is mounted on a surface of the first circuit board 12 facing upward in FIG. 1 (hereinafter, referred to an upper surface of the first circuit board 12) to be fixed to the first circuit board 12.

A plurality of first contacts 14 are arranged on the insulating housing 13 in a longitudinal direction of the same to make a couple of parallel lines each elongating along the longitudinal direction of the insulating housing 13. Each of the first contacts 14 is made of resilient conductive plate material to be shaped into a bended stripe and provided, respectively at both end portions of the bended stripe, with a board connecting portion 14*a* operative to be connected with a circuit terminal provided on the upper surface of the first circuit board 12 and a contact-connecting portion 14*b* operative to come into contact with a second contact provided in a receptacle connector constituting a second connector included in the embodiment of circuit board connecting device according to the present invention, as described later.

Further, a first fixing metallic member 15 is attached to the insulating housing 13 for surrounding the same along the upper surface of the first circuit board 12 so as to cover partially the outer surface of the insulating housing 13. A plurality of board joining portions 16 are provided on the first fixing metallic member 15 to be joined to the upper surface of the first circuit board 12. The first fixing metallic member 15 is operative to fix the insulating housing 13 to the first circuit board 12 when the board joining portions 16 are joined to the upper surface of the first circuit board 12.

The plug connector 11 having the insulating housing 13, the first contacts 14 and the first fixing metallic member 15 is further provided thereon with a resilient movable holding member 18 elongating in a direction along which the first contacts 14 are arranged, that is, the longitudinal direction of the first insulating housing. A pair of end portions 19 of the resilient movable holding member 18 are supported respectively by a couple of side end portions 21 of the first fixing metallic member 15 positioned respectively at end portions of the insulating housing 13 in its longitudinal direction. The resilient movable holding member 18 is formed by bending a resilient metallic bar or the like and each of the end portions 19 of the resilient movable holding member 18 supported respectively by the side end portions 21 of the first fixing metallic member 15 is movable resiliently to the side end portion 21 of the first fixing metallic member 15 in the longitudinal direction of the insulating housing 13.

Each of the side end portions 21 of the first fixing metallic member 15 is provided thereon with a hole 21*a* through which the end portion 19 of the resilient movable holding member 18 passes in the longitudinal direction of the insulating housing 13 from the outside to the inside of the first fixing metallic member 15 to be supported by the side end portion 21 of the first fixing metallic member 15. A condition wherein the end portion 19 of the resilient movable holding member 18 is put in passing through the hole 21*a* provided on the side end portions 21 of the first fixing metallic member 15 in the longitudinal direction of the insulating housing 13 from the outside to the inside of the first fixing metallic member 15, is stably maintained with resiliency of the resilient movable holding member 18 by which both of the end portions 19 of the resilient movable holding member 18 are caused to move from the outside to the inside of the first fixing metallic member 15. Further, each of side plate portions 20 included respectively in a pair of end portions of the insulating housing 13 and placed in the inside of the side end portion 21 of the first fixing metallic member 15 to face to the same, is provided with a supporting portion 22 formed in the shape of a groove for supporting, together with the side end portion 21 of the first fixing metallic member 15, the end portion 19 of the resilient movable holding member 18 having passed through the hole 21*a* provided on the side end portions 21 of the first fixing metallic member 15.

A middle portion 23 between the end portions 19 of the resilient movable holding member 18 is put in contact with a flat portion 24 between the side end portions 21 of the first fixing metallic member 15 and thereby the resilient movable holding member 18 is prevented from rotating with a rotational axis passing through the end portions 19 of the resilient movable holding member 18 supported respectively by the side end portion 21 of the first fixing metallic member 15.

Figure 3:
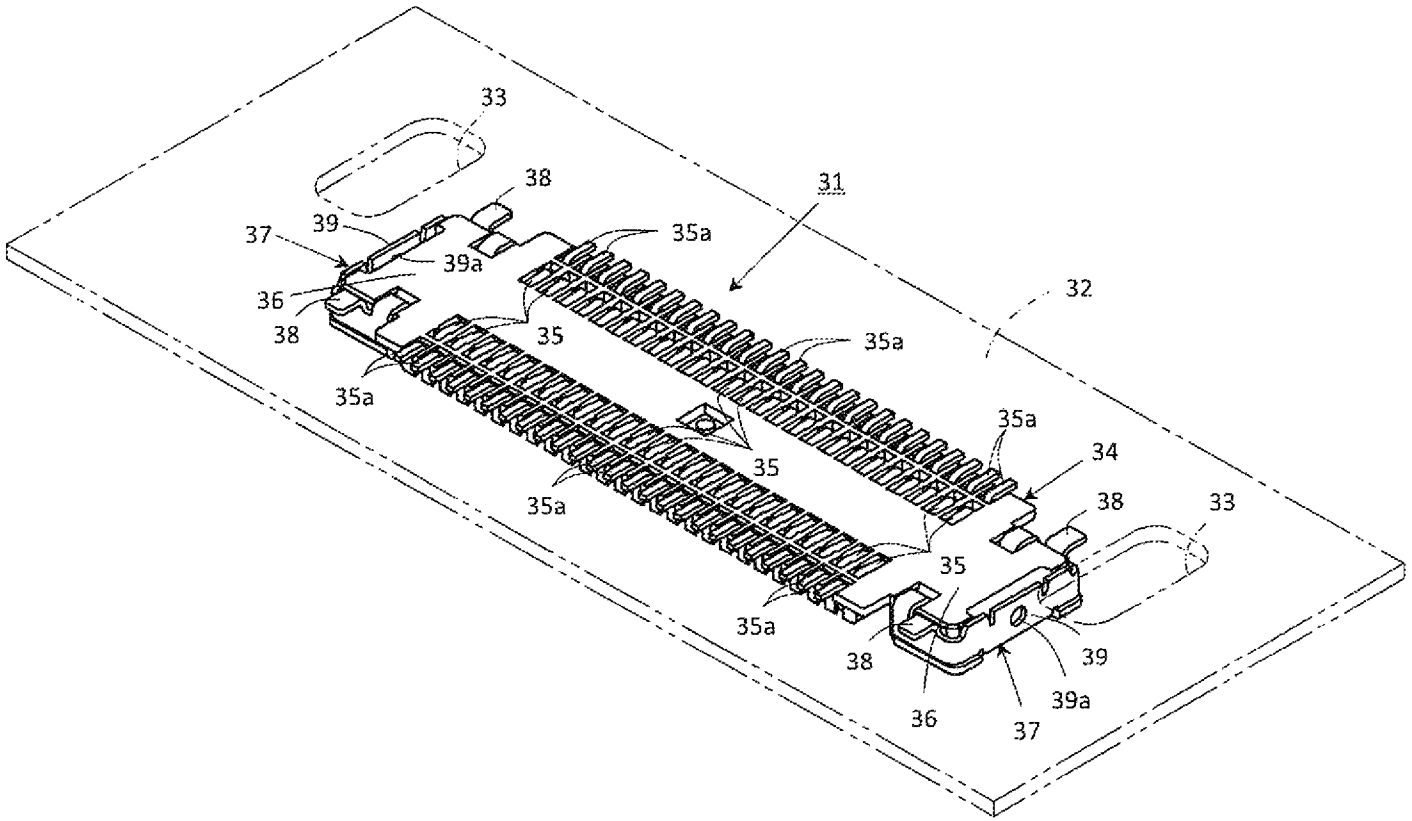
FIG. 3 is a schematic perspective view showing a receptacle connector included in the embodiment of circuit board connecting device according to the present invention, together with a second circuit board on which an insulating housing of the receptacle connector is fixed and which is shown by imaginary lines.
Figure 4:
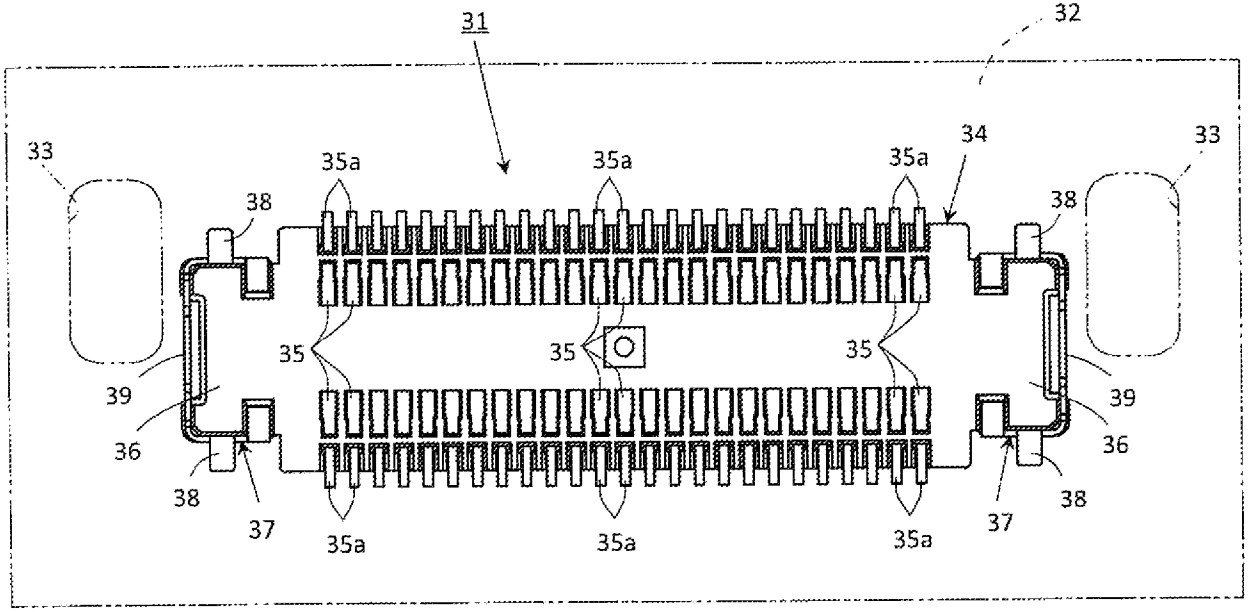
FIG. 4 is a schematic plan view showing the receptacle connector and the second circuit board shown by imaginary lines.
Figure 5:
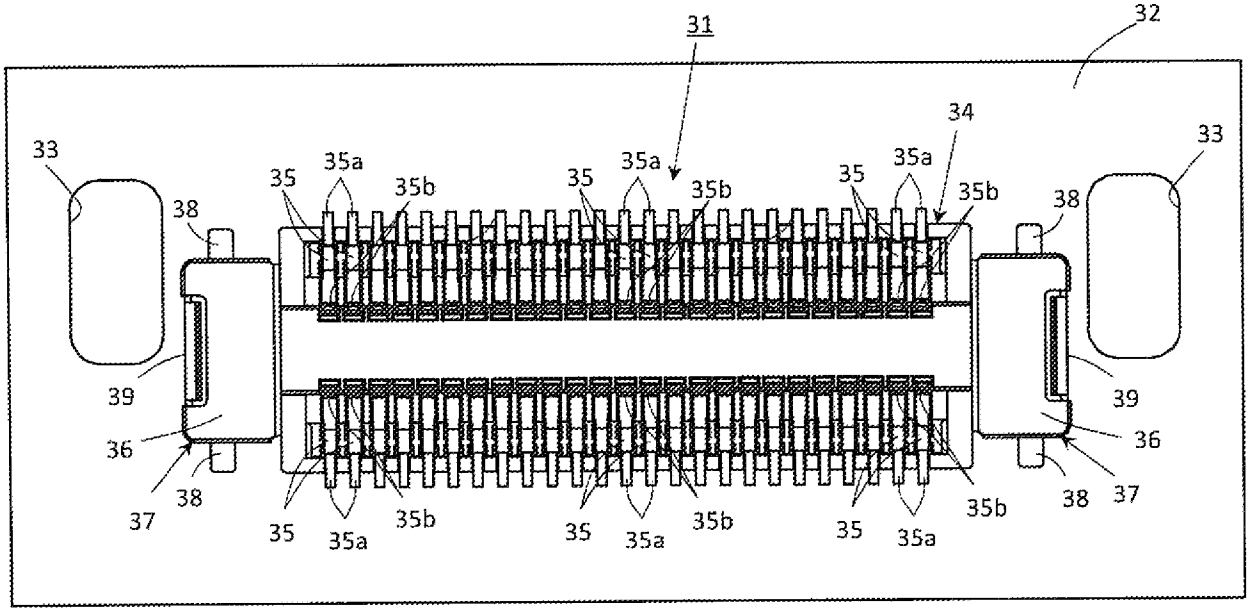
FIG. 5 is a schematic bottom view showing the receptacle connector and the second circuit board.

Each of FIGS. 3 and 4 shows a receptacle connector 31 which constitutes a second connector included in the embodiment of circuit board connecting device according to the present invention and a second circuit board 32 on which the receptacle connector 31 is provided and which is shown with imaginary lines (two-dot chain lines). Further, FIG. 5 is a schematic bottom view showing the receptacle connector 31 and the second circuit board 32 on which the receptacle connector 31 is provided. Hereinafter, a surface of the second circuit board 32 facing downward in FIG. 3 is referred to a lower surface of the second circuit board 32 and a surface of the second circuit board 32 facing upward in FIG. 3 is referred to an upper surface of the second circuit board 32.

As shown in FIG. 3, the receptacle connector 31 is attached to the lower surface of the second circuit board 32. A couple of holes 33 are formed on the second circuit board 32, each of which passes through the upper and lower surfaces of the second circuit board 32. It is possible to look in at each of the holes 33 from the outside of the upper surface of the second circuit board 32.

As shown in FIGS. 3 to 5, the receptacle connector 31 has an insulating housing 34 made of insulator such as plastics or the like to constitute a second insulating housing. The insulating housing 34 is mounted on the lower surface of the second circuit board 32 to be fixed to the second circuit board 32.

A plurality of second contacts 35 are arranged on the insulating housing 34 in a longitudinal direction of the same to make a couple of parallel lines each elongating along the longitudinal direction of the insulating housing 34. Each of the second contacts 35 is made of resilient conductive plate material to be shaped into a bended stripe and provided, respectively at both end portions of the bended stripe, with a board connecting portion 35*a* operative to be connected with a circuit terminal (not shown in the drawings) provided on the lower surface of the second circuit board 32 and a contact-connecting portion 35*b* operative to come into contact with the first contact 14 provided in the plug connector 11.

Further, a second fixing metallic member 37 which is divided into a couple of parts positioned respectively at a pair of end portions 36 of the insulating housing 34 in the longitudinal direction of the same is attached to the insulating housing 34. A plurality of board joining portions 38 are provided on each of separated parts of the second fixing metallic member 37 to be joined to the lower surface of the second circuit board 32. The second fixing metallic member 37 is operative to fix the insulating housing 34 to the second circuit board 32 when the board joining portions 38 are joined to the lower surface of the second circuit board 32.

A side end portion 39 of each of the separated parts of the second fixing metallic member 37 is provided thereon with a hole 39*a* which is operative to be engaged with the end portion 19 of the resilient movable holding member 18 provided on the plug connector 11. The hole 39*a* constitutes an engaging portion formed on each of separated portions of the second fixing metallic member 37, with which the end portion 19 of the resilient movable holding member 18 supported by the side end portion 21 of the first fixing metallic member 15 is caused to engage. When the end portion 19 of the resilient movable holding member 18 is caused to engage with the engaging portion, the end portion 19 of the resilient movable holding member 18 passes through the hole 39*a* provided on the side end portion 39 of the second fixing metallic member 37 in the longitudinal direction of the insulating housing 34 from the outside to the inside of the second fixing metallic member 37. A condition wherein the end portion 19 of the resilient movable holding member 18 is put in passing through the hole 39*a* provided on the side end portion 39 of the second fixing metallic member 37 in the longitudinal direction of the insulating housing 34 from the outside to the inside of the second fixing metallic member 37, is stably maintained with resiliency of the resilient movable holding member 18 by which both of the end portions 19 of the resilient movable holding member 18 are caused to move from the outside to the inside of the second fixing metallic member 37.

Under such a condition, when the lower surface of the second circuit board 32 on which the insulating housing 34 of the receptacle connector 31 is mounted is caused to face to the upper surface of the first circuit board 12 on which the insulating housing 13 of the plug connector 11 is mounted and then the second circuit board 32 is closely laid on top of the first circuit board 12, the plug connector 11 and the receptacle connector 31 constituting respectively the first and second connectors included in the embodiment of circuit board connecting device according to the present invention are put in mutual engagement wherein the insulating housing 34 of the receptacle connector 31 is coupled with the insulating housing 13 of the plug connector 11.

Figure 6:
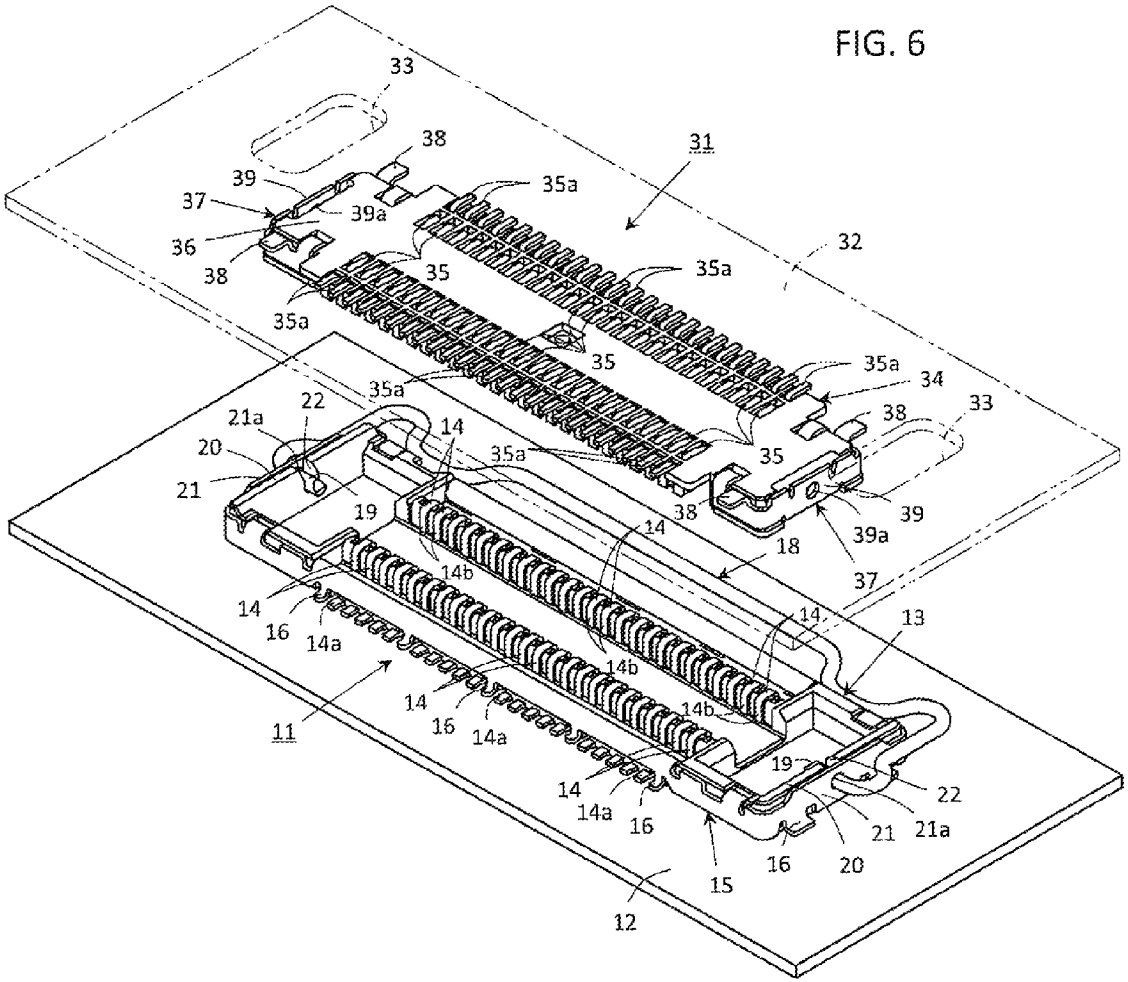
FIG. 6 is a schematic perspective view showing the plug connector accompanied with the first circuit board and the receptacle connector accompanied with the second circuit board shown by imaginary lines and opposite to the plug connector.

On that occasion, first, as shown in FIG. 6 in which the second circuit board 32 is shown with imaginary lines, the receptacle connector 31 accompanied with the second circuit board 32 is positioned to be opposite to the plug connector 11 accompanied with the first circuit board 12 so that the insulating housing 34 of the receptacle connector 31 is caused to face to the insulating housing 13 of the plug connector 11 and the second contacts 35 arranged on the insulating housing 34 of the receptacle connector 31 are positioned to correspond respectively to the first contacts 14 arranged on the insulating housing 13 of the plug connector 11.

Figure 7:
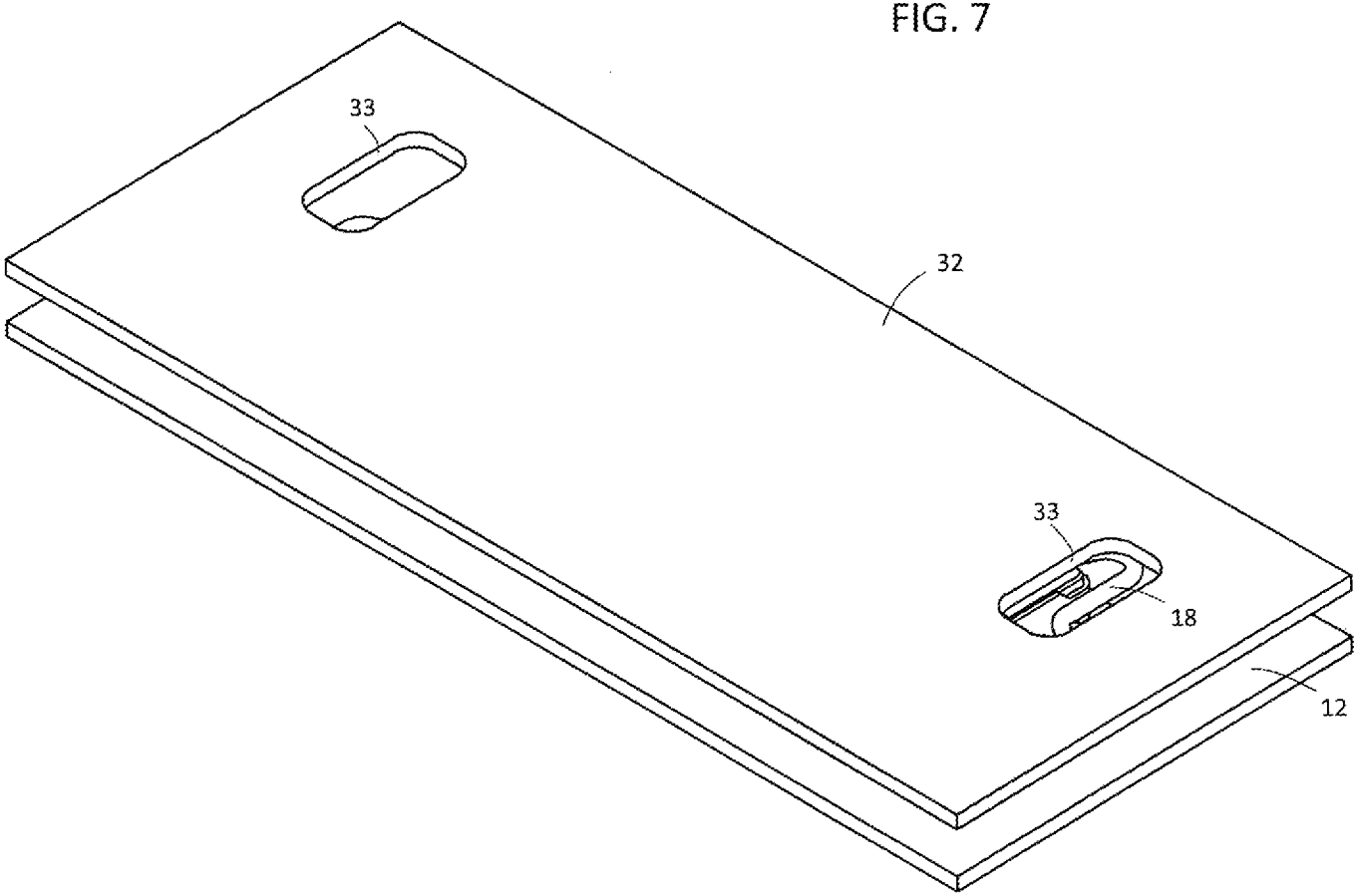
FIG. 7 is a schematic perspective view showing a condition wherein the receptacle connector accompanied with the second circuit board is engaged with the plug connector shown accompanied with the first circuit board.
Figure 8:
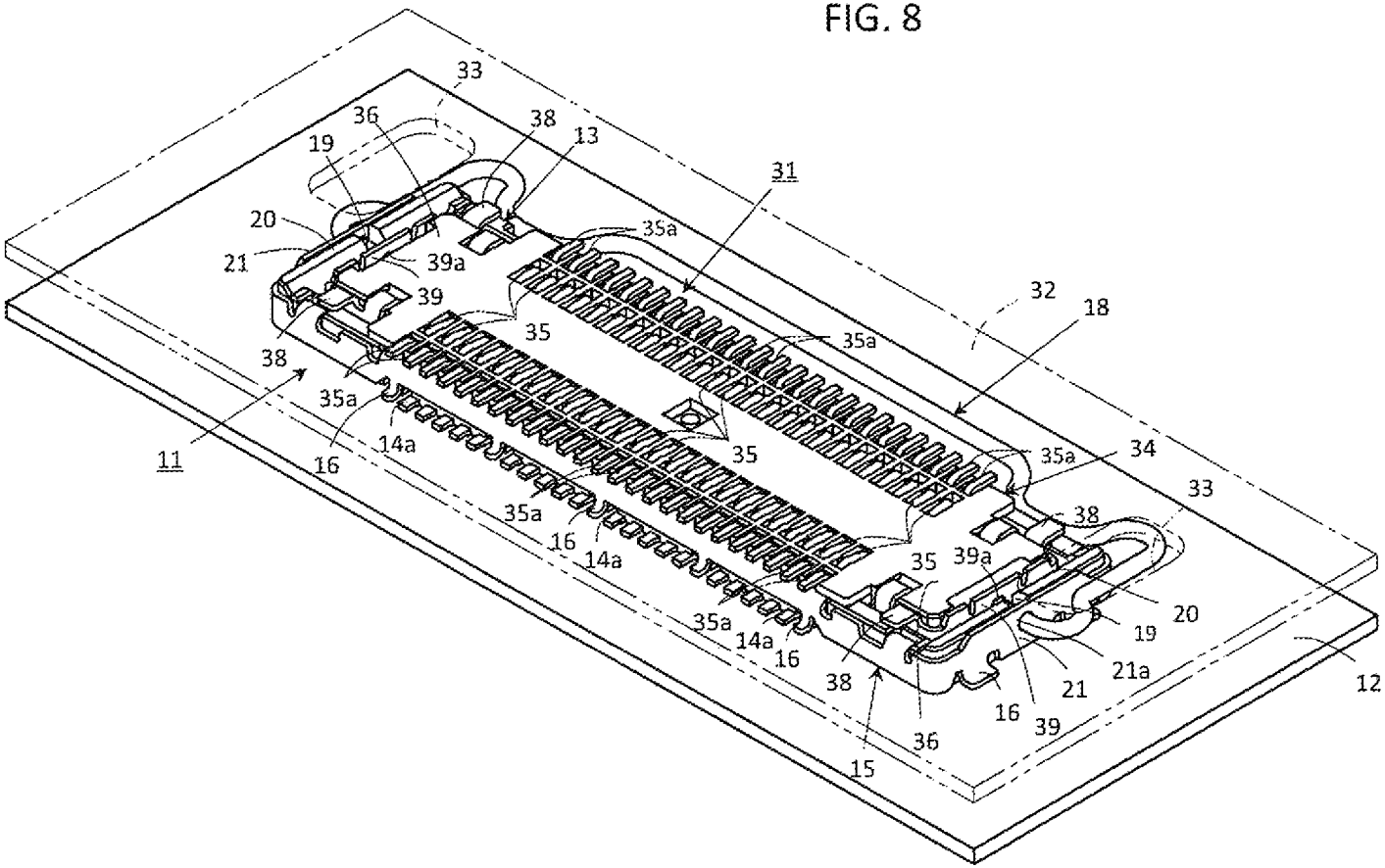
FIG. 8 is a schematic perspective view showing a condition wherein the receptacle connector accompanied with the second circuit board shown by imaginary lines is engaged with the plug connector accompanied with the first circuit board.
Figure 9:
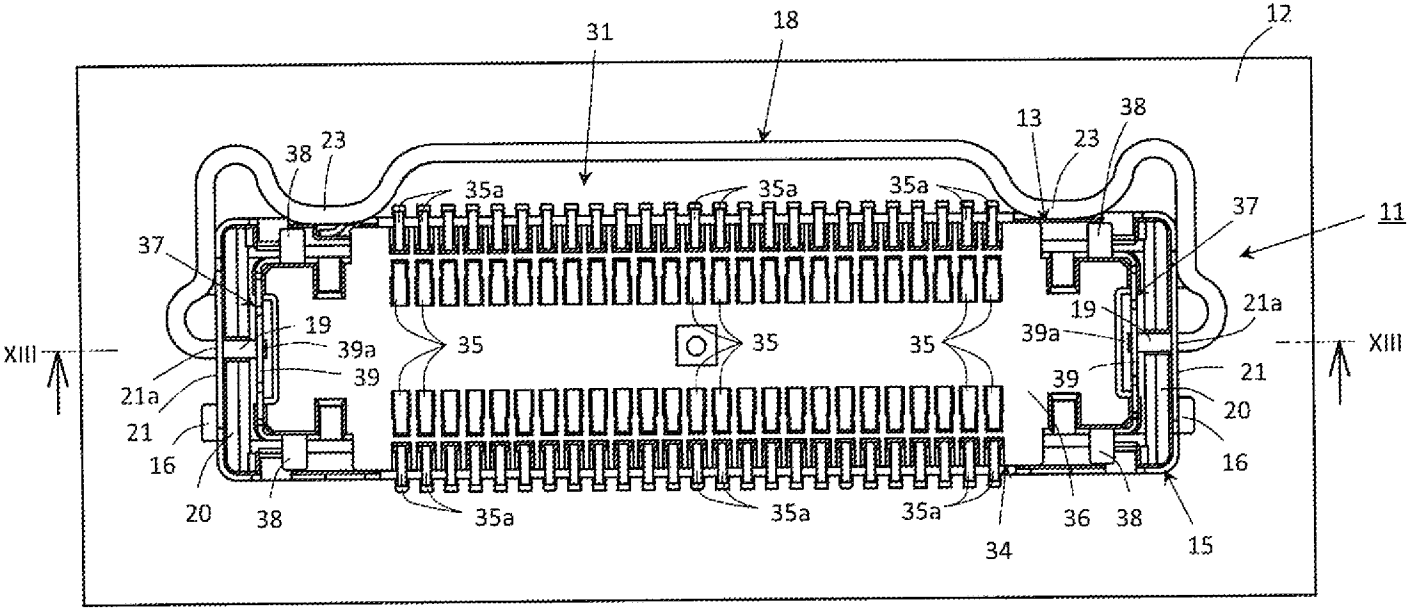
FIG. 9 is a schematic plan view showing a condition wherein the receptacle connector is engaged with the plug connector accompanied with the first circuit board and the second circuit board is eliminated for convenience' sake.
Figure 10:
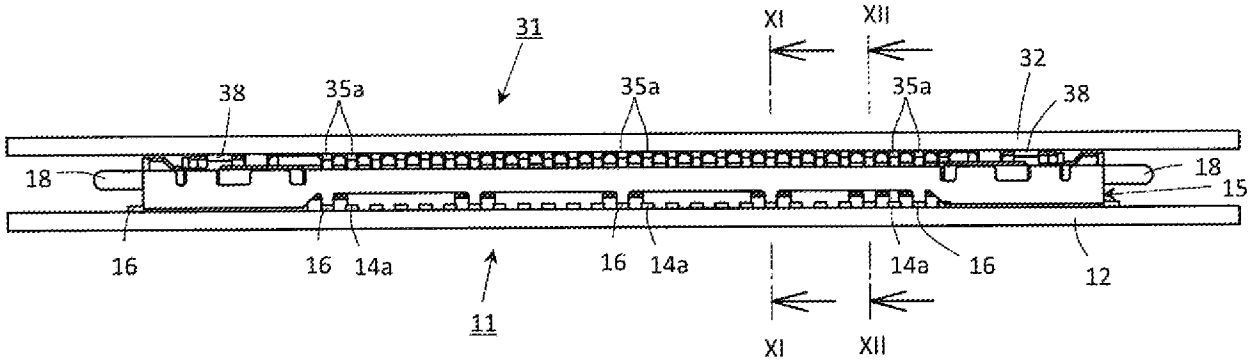
FIG. 10 is a schematic front view showing the condition wherein the receptacle connector accompanied with the second circuit board is engaged with the plug connector accompanied with the first circuit board.

Next, when the second circuit board 32 is so positioned that the lower surface of the second circuit board 32 on which the insulating housing 34 of the receptacle connector 31 is mounted is opposite to the upper surface of the first circuit board 12 on which the insulating housing 13 of the plug connector 11 is mounted and then closely laid on top of the first circuit board 12, the insulating housing 34 of the receptacle connector 31 is coupled with the insulating housing 13 of the plug connector 11 and thereby the receptacle connector 31 accompanied with the second circuit board 32 and the plug connector 11 accompanied with the first circuit board 12 are put in mutual engagement, as shown in FIG. 7, FIG. 8 in which the second circuit board 32 is shown with imaginary lines, FIG. 9 in which the second circuit board 32 is omitted to be shown, and FIG. 10

Figure 11:
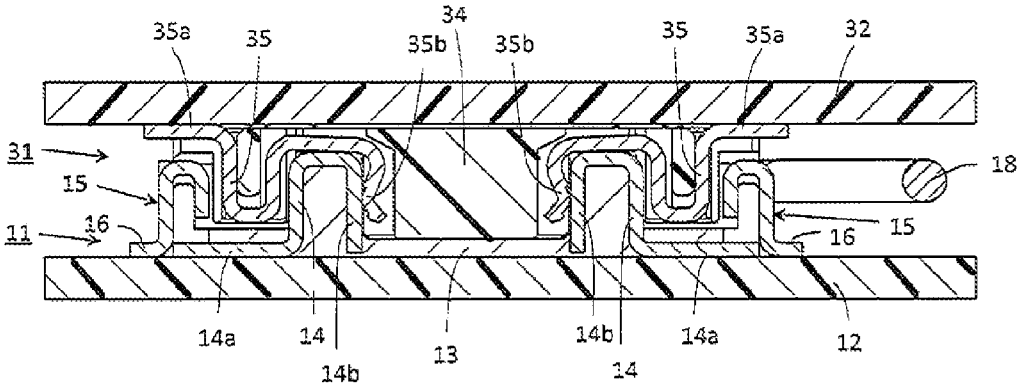
FIG. 11 is a schematic cross-sectional view taken along line XI-XI in FIG. 10.
Figure 12:
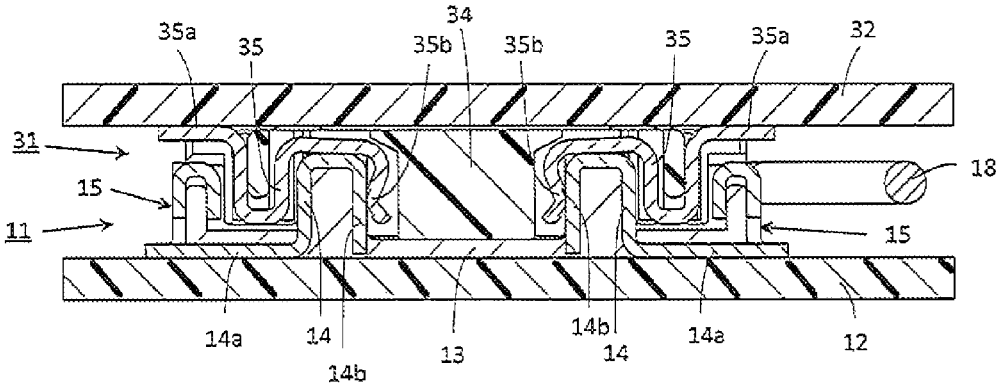
FIG. 12 is a schematic cross-sectional view taken along line XII-XII in FIG. 10.

Under a condition wherein the receptacle connector 31 and the plug connector 11 are put in mutual engagement, as shown in FIG. 11 showing a cross-section taken along line XI-XI in FIG. 10 and FIG. 12 showing a cross-section taken along line XII-XII in FIG. 10, the contact-connecting portion 35*b* of each of the second contacts 35 arranged on the insulating housing 34 of the receptacle connector 31 is caused to come into contact with the contact-connecting portion 14*b* of a corresponding one of the first contacts 14 arranged on the insulating housing 13 of the plug connector 11. Thereby, each of the circuit terminals provided on the lower surface of the second circuit board 32, with which the board connecting portion 35*a* of the second contact 35 is connected, is linked through the second contact 35 and the first contact 14 to a corresponding one of the circuit terminals provided on the upper surface of the first circuit board 12, with which the board connecting portion 14*a* of the first contact 14 is connected, so that the first circuit board 12 and the second circuit board 32 are put in a condition of mutual electrical connection.

Figure 13:
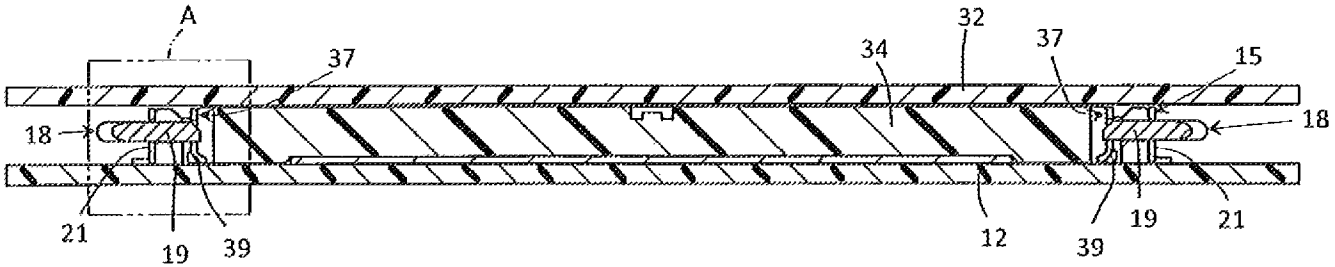
FIG. 13 is a schematic cross-sectional view taken along line XIII-XIII in FIG. 9.
Figure 14:
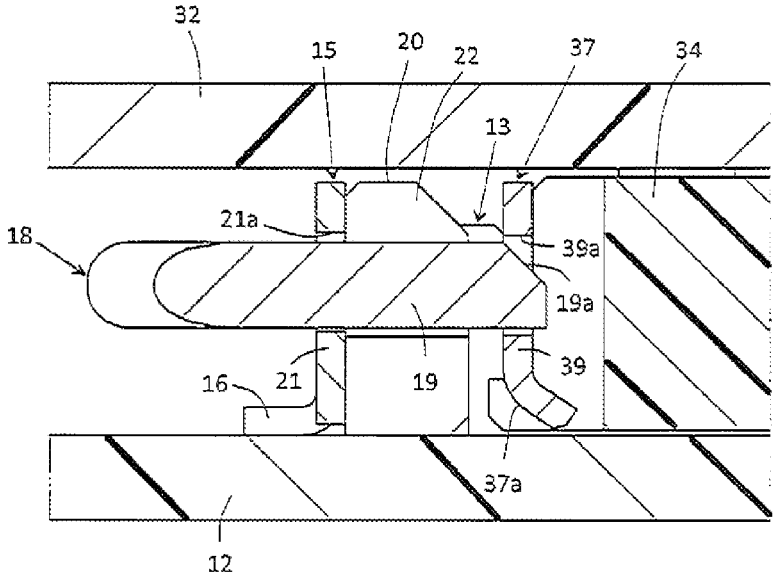
FIG. 14 is a schematic enlarged partial cross-sectional view showing an inside of a tow-dot chain line frame A in FIG. 13.

Further, as shown in FIG. 13 showing a cross-section taken along line XIII-XIII in FIG. 9 and FIG. 14 showing an inside of a tow-dot chain line frame A in FIG. 13, each of the end portions 19 of the resilient movable holding member 18 which has passed through the hole 21*a* provided on the side end portion 21 of the first fixing metallic member 15 in the plug connector 11 in the longitudinal direction of the insulating housing 13 of the plug connector 11 from the outside to the inside of the first fixing metallic member 15 to be supported by the side end portion 21 of the first fixing metallic member 15 is caused to pass through the hole 39*a* provided on the side end portion 39 of the second fixing metallic member 37 in the receptacle connector 31 in the longitudinal direction of the insulating housing 34 from the outside to the inside of the second fixing metallic member 37. That is, each of the end portions 19 of the resilient movable holding member 18 provided on the plug connector 11 is caused to engage with the engaging portion (the hole 39*a*) formed on the side end portion 39 of the second fixing metallic member 37 in the receptacle connector 31, so that the insulating housing 34 of the receptacle connector 31 is held by the end portions 19 of the resilient movable holding member 18 supported respectively by the side end portions 21 of the first fixing metallic member 15 in the plug connector 11.

Figure 15:
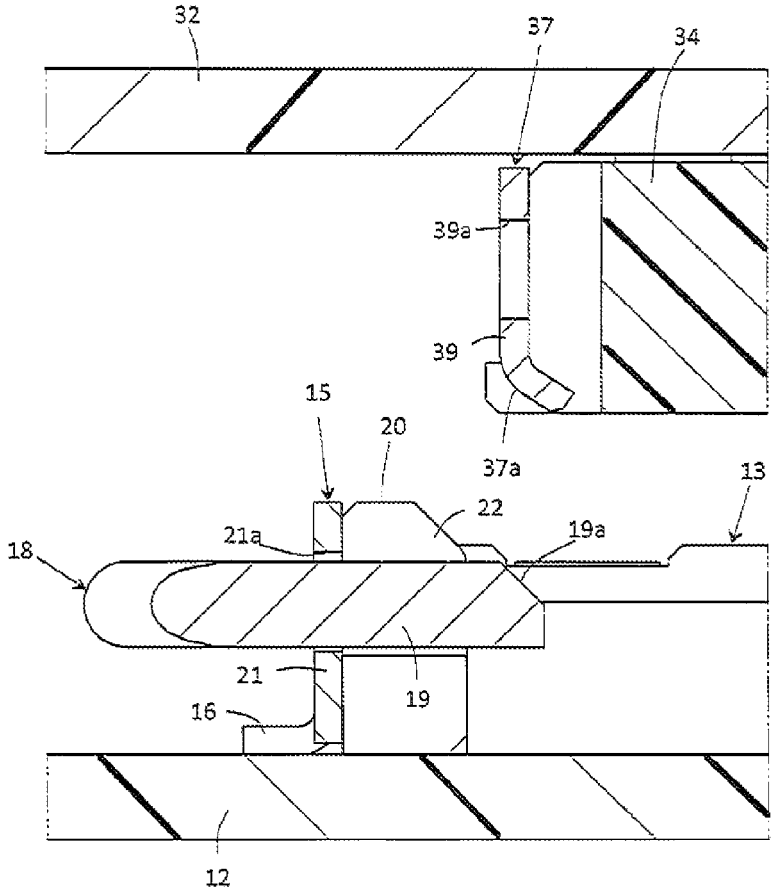
FIG. 15 is a schematic partial cross-sectional view used for explaining a positional relation between the resilient movable holding member provided on the plug connector and an engaging portion of the receptacle connector under the condition wherein the receptacle connector accompanied with the second circuit board is engaged with the plug connector accompanied with the first circuit board.

The end portion 19 of the resilient movable holding member 18 and the hole 39*a* formed on the side end portion 39 of the second fixing metallic member 37 have a mutual positional relation wherein the hole 39*a* formed on the side end portion 39 of the second fixing metallic member 37 is positioned above the end portion 19 of the resilient movable holding member 18 as shown in FIG. 15 when the receptacle connector 31 accompanied with the second circuit board 32 is positioned to be opposite to the plug connector 11 accompanied with the first circuit board 12 as shown in FIG. 6. After that, when the second circuit board 32 is closely laid on top of the first circuit board 12, the second fixing metallic member 37 is moved downward in FIG. 15 to approach the end portion 19 of the resilient movable holding member 18 and a bended portion 37*a* of the second fixing metallic member 37 comes into contact with a slant surface 19*a* formed on the end portion 19 of the resilient movable holding member 18 to push the same downward in FIG. 15. Thereby, the end portion 19 of the resilient movable holding member 18 is once moved resiliently to the left in FIG. 15 and then contrarily moved resiliently to the right in FIG. 15 in the hole 39*a* formed on the side end portion 39 of the second fixing metallic member 37 with its own resiliency so as to return to the original position when the second fixing metallic member 37 is further moved downward in FIG. 15 and the bended portion 37*a* of the second fixing metallic member 37 is caused to get out of the slant surface 19*a* formed on the end portion 19 of the resilient movable holding member 18. As a result, the end portion 19 of the resilient movable holding member 18 is put in passing through the hole 39*a* formed on the side end portion 39 of the second fixing metallic member 37.

In such a manner as described above, the end portions 19 of the resilient movable holding member 18 provided on the plug connector 11 are caused to engage respectively with the engaging portions (the holes 39*a*) formed respectively on the side end portions 39 of the second fixing metallic member 37 for holding the insulating housing 34 of the receptacle connector 31 and thereby the insulating housing 34 of the receptacle connector 31 is effectively prevented from getting out unwillingly of the insulating housing 13 of the plug connector 11.

The end portions 19 of the resilient movable holding member 18 supported respectively by the side end portions 21 of the first fixing metallic member 15 in the plug connector 11 and the engaging portions (the holes 39*a*) formed respectively on the side end portions 39 of the second fixing metallic member 37 in the receptacle connector 31 constitute holding means included in the embodiment of circuit board connecting device according to the present invention, which is operative to prevent the insulating housing 34 of the receptacle connector 31 from being separated from the insulating housing 13 of the plug connector 11 under the condition wherein the insulating housing 13 of the plug connector 11 and the insulating housing 34 of the receptacle connector 31 are coupled with each other.

Figure 16:
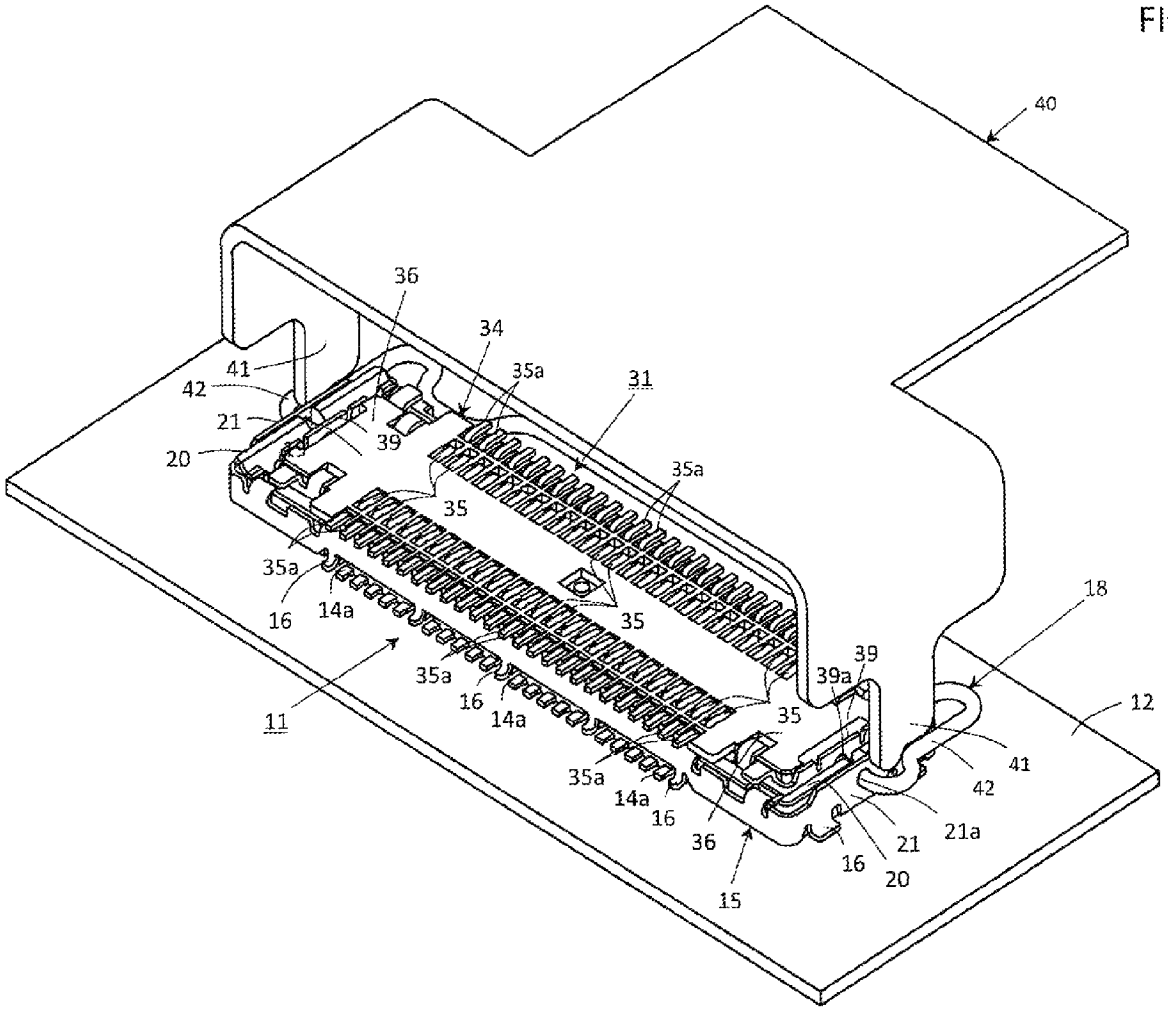
FIG. 16 is a schematic perspective view showing a condition wherein a releasing tool is engaged with a resilient movable holding member provided on the plug connector under the condition wherein the receptacle connector is engaged with the plug connector accompanied with the first circuit board and the second circuit board is eliminated for convenience' sake.

Then, when a couple of engaging projections 41 of a releasing tool 40 are manually inserted from the outside of the second circuit board 32 through the holes 33 formed on the second circuit board 32 into a space between the second circuit board 32 and the first circuit board 12 and each of the engaging projections 41 of the releasing tool 40 is manually put forcibly between the side end portion 21 of the first fixing metallic member 15 in the plug connector 11 and a portion 42 of the resilient movable holding member 18, which is formed between the end portion 19 and the middle portion 23 of the resilient movable holding member 18, as shown in FIG. 16 in which the second circuit board 32 is omitted to be shown, the portion 42 of the resilient movable holding member 18 is resiliently moved, together with the end portion 19 of the resilient movable holding member 18, to go away from the side end portion 21 of the first fixing metallic member 15.

Figure 17:
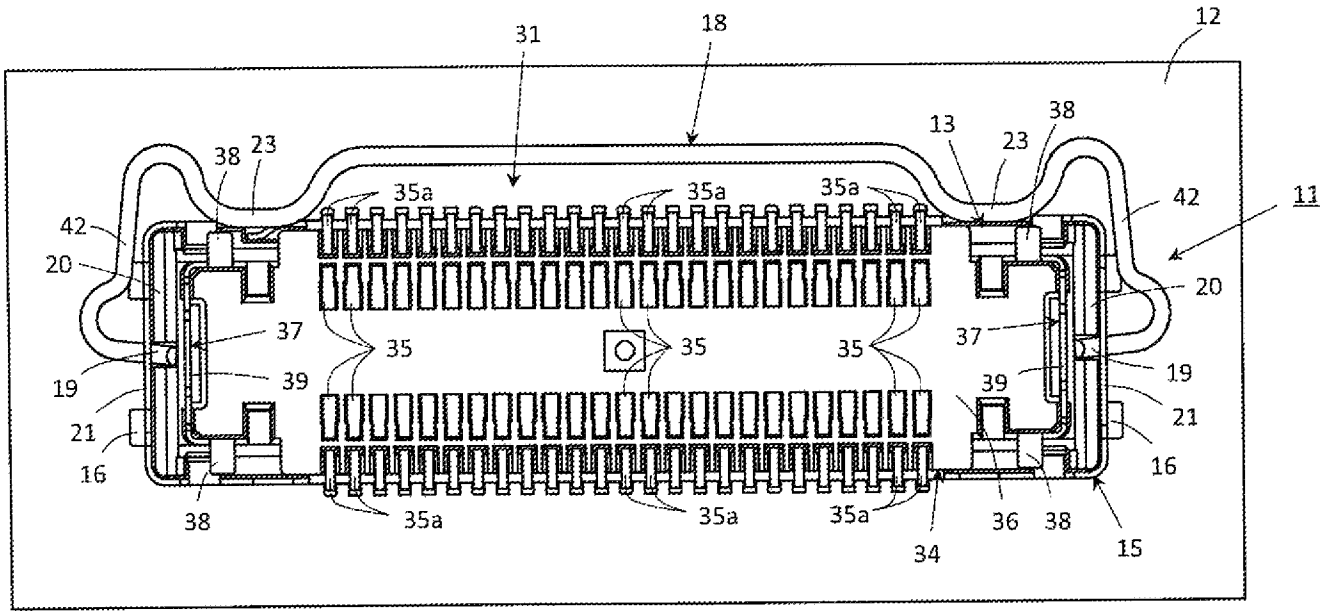
FIG. 17 is a schematic plan view showing a condition wherein each of end portions of the resilient movable holding member is resiliently shifted in position under the condition wherein the receptacle connector is engaged with the plug connector accompanied with the first circuit board and the second circuit board is eliminated for convenience' sake.

Thereby, each of the end portions 19 of the resilient movable holding member 18 is resiliently moved by the engaging projections 41 of the releasing tool 40 in the longitudinal direction of the insulating housing 34 from the inside to the outside of the second fixing metallic member 37 in the receptacle connector 31 so as to disengage from the hole 39*a* formed on the side end portion 39 of the second fixing metallic member 37, as shown in FIG. 17 in which the second circuit board 32 and the releasing tool 40 are omitted to be shown.

With the resilient movement to disengage from the hole 39*a* formed on the side end portion 39 of the second fixing metallic member 37, each of the end portions 19 of the resilient movable holding member 18 causes the insulating housing 34 of the receptacle connector 31 to be released from holding by the end portions 19 of the resilient movable holding member 18. As a result, the insulating housing 34 of the receptacle connector 31 is able to be smoothly separated from the insulating housing 13 of the plug connector 11 so that the receptacle connector 31 and the plug connector 11 are released from the mutual engagement.

After that, when the engaging projections 41 of the releasing tool 40 are manually pulled out through the holes 33 formed on the second circuit board 32 from the space between the second circuit board 32 and the first circuit board 12 and thereby each of the engaging projections 41 of the releasing tool 40 put forcibly between the side end portion 21 of the first fixing metallic member 15 in the plug connector 11 and the portion 42 of the resilient movable holding member 18 is removed, the portion 42 of the resilient movable holding member 18 is moved, together with the end portion 19 of the resilient movable holding member 18, with its own resiliency to return to the original position. As a result, the condition wherein each of the end portions 19 of the resilient movable holding member 18 is put in passing through the hole 21*a* formed on the side end portion 21 of the first fixing metallic member 15 in the plug connector 11 to be supported by the side end portion 21 of the first fixing metallic member 15 is stably maintained.

With the embodiment of circuit board connecting device including the plug connector 11 and the receptacle connector 31 as described above, when the insulating housing 34 of the receptacle connector 31 is coupled with the insulating housing 13 of the plug connector 11 and the second contacts 35 arranged on the insulating housing 34 of the receptacle connector 31 are put in contact respectively with the first contacts 14 arranged on the insulating housing 13 of the plug connector 11, the end portions 19 of the resilient movable holding member 18 provided on the plug connector 11 are caused to hold the insulating housing 34 of the receptacle connector 31 and thereby the insulating housing 34 of the receptacle connector 31 is prevented from being unwillingly separated from the insulating housing 13 of the plug connector 11.

The resilient movable holding member 18 provided on the plug connector 11 is formed by bending the resilient metallic bar or the like to elongate along the longitudinal direction of the insulating housing 13 of the plug connector 11 and the end portions 19 of the resilient movable holding member 18 are supported respectively by the side end portions 21 of the first fixing metallic member 15 in the plug connector 11 positioned respectively at end portions of the insulating housing 13 of the plug connector 11 in its longitudinal direction. Each of the end portions 19 of the resilient movable holding member 18 supported respectively by the side end portions 21 of the first fixing metallic member 15 in the plug connector 11 is caused to engage with the hole 39*a* constituting the engaging portion formed on the side end portion 39 of the second fixing metallic member 37 in the receptacle connector 31 for holding the insulating housing 34 of the receptacle connector 31.

The condition of engagement wherein each of the end portions 19 of the resilient movable holding member 18 engages with the hole 39*a* formed on the side end portion 39 of the second fixing metallic member 37 in the receptacle connector 31 is maintained with resiliency of the resilient movable holding member 18 and thereby the insulating housing 34 of the receptacle connector 31 is put in a stable holding by the end portions 19 of the resilient movable holding member 18. Then, when each of the end portions 19 of the resilient movable holding member 18 is resiliently moved to disengage from the hole 39*a* formed on the side end portion 39 of the second fixing metallic member 37 in the receptacle connector 31, for example, by means of the engaging projection 41 of the releasing tool 40 engaged with the end portion 19 of the resilient movable holding member 18, the condition of engagement wherein each of the end portions 19 of the resilient movable holding member 18 engages with the hole 39*a* formed on the side end portion 39 of the second fixing metallic member 37 in the receptacle connector 31 is broken, so that the insulating housing 34 of the receptacle connector 31 is able to be separated from the insulating housing 13 of the plug connector 11.

Accordingly, with the end portions 19 of the resilient movable holding member 18 provided on the plug connector 11 and the holes 39*a* constituting the engaging portions formed respectively on the separated parts of the second fixing metallic member 37 in the receptacle connector 31, which constitute the holding means, the mutual coupling between the insulating housing 13 of the plug connector 11 and the insulating housing 34 of the receptacle connector 31 is stably and firmly maintained, and then the insulating housing 34 of the receptacle connector 31 can be smoothly separated from the insulating housing 13 of the plug connector 11 by quite simple and easy operations under the condition wherein the insulating housing 13 of the plug connector 11 and the insulating housing 34 of the receptacle connector 31 are coupled with each other.

Further, with the resilient movable holding member 18 provided on the plug connector 11 to elongate along the longitudinal direction of the insulating housing 13 of the plug connector 11 and to have the end portions thereof supported respectively by the portions of the first fixing metallic member 15 positioned respectively to the end portions of the insulating housing 13 in its longitudinal direction, a thickness of the device between the first circuit board 12 and the second circuit board 32 in a direction perpendicular to each of the surface of the first circuit board 12 and the surface of the second circuit board 32 facing each other, on one of which the insulating housing 13 of the plug connector 11 is mounted and on the other of which the insulating housing 34 of the receptacle connector 31 is mounted, can be effectively reduced under the condition wherein the first circuit board 12 and the second circuit board 32 are put in the electrical piled-up connection.

The invention claimed is:

1. A circuit board connecting device which connects a first circuit board and a second circuit board having a hole, and separates the first circuit board from the second circuit board with a releasing tool having an engaging projection, the circuit board connecting device comprising:

a first connector which has a first insulating housing, a plurality of first contacts arranged on the first insulating housing, each of which is provided with a board connecting portion operative to be connected with a circuit terminal provided on the first circuit board, and a first fixing metallic member attached to the first insulating housing for fixing the first insulating housing to the first circuit board;

a second connector which has a second insulating housing operative to be coupled with the first insulating housing, a plurality of second contacts arranged on the second insulating housing, each of which is provided with a board connecting portion operative to be connected with a circuit terminal provided on the second circuit board and is operative to come into contact with a corresponding one of the first contacts, and a second fixing metallic member attached to the second insulating housing for fixing the second insulating housing to the second circuit board;

a resilient movable holding member provided on the first connector to elongate along a longitudinal direction of the first insulating housing so as to have a pair of end portions supported respectively by a couple of portions of the first fixing metallic member positioned respectively at a pair of end portions of the first insulating housing in the longitudinal direction of the first insulating housing; and a pair of engaging portions formed respectively on a couple of portions of the second fixing metallic member positioned respectively at a pair of end portions of the second insulating housing in a longitudinal direction of the second insulating housing so that the end portions of the resilient movable holding member are caused to engage respectively with the engaging portions for holding the second insulating housing when the second insulating housing is coupled with the first insulating housing, wherein the resilient movable holding member is formed with a single resilient metallic bar bent to form the end portions to be supported respectively by the portions of the first fixing metallic member for moving resiliently in regard to the portions of the first fixing metallic member, wherein a middle portion between the end portions of the resilient movable holding member is put in contact with a flat portion between the portions of the first fixing metallic member so that the resilient movable holding member is prevented from rotating with a rotational axis passing through the end portions of the resilient movable holding member supported respectively by the portions of the first fixing metallic member, wherein when each of the end portions of the resilient movable holding member is resiliently moved to be disengaged from the respective engaging portion provided on the respective portion of the second fixing metallic member, the second insulating housing is released from holding by the end portions of the resilient movable holding member, wherein each of the end portions of the resilient movable holding member is resiliently moved with the engaging projection of the releasing tool which is inserted from the outside of the second circuit board through the hole formed on the second circuit board into a space between the second circuit board and the first circuit board so as to be put forcibly between a respective one of the portions of the first fixing metallic member and a portion of the resilient movable holding member provided between a respective one of the end portions and the middle portion of the resilient movable holding member, wherein each of the engaging portions provided respectively on the portions of the second fixing metallic member is constituted with a round hole through which the end portion of the resilient movable holding member supported by the portion of the first fixing metallic member passes in the longitudinal direction of the first insulating housing from the outside to the inside of the second fixing metallic member when the end portion of the resilient movable holding member is caused to engage with the engaging portion, and wherein each of the portions of the second fixing metallic member is provided with a bent portion and each of the end portions of the resilient movable holding member is provided with a slant surface, so that the bent portion comes into contact with the slant surface to push the slant surface downward so as to cause the end portions of the resilient movable holding member to be resiliently moved in the longitudinal direction of the first insulating housing when the second insulating housing is in process of coupling with the first insulating housing and the second fixing metallic member is moved downward to the end portions of the resilient movable holding member.

2. A circuit board connecting device according to claim 1, wherein each of the end portions of the first insulating housing in the longitudinal direction of the first insulating housing is provided thereon with a supporting portion for supporting, together with the portion of the first fixing metallic member, the end portion of the resilient movable holding member.

3. A circuit board connecting device according to claim 1, wherein each of the portions of the first fixing metallic member is provided thereon with a hole through which the end portion of the resilient movable holding member passes to be supported by the portion of the first fixing metallic member.

* * * * *